US005295701A

United States Patent [19]

Reiber et al.

[11] Patent Number: 5,295,701

[45] Date of Patent: Mar. 22, 1994

[54] IN LINE ROLLER SKATE ASSEMBLY HAVING TRAINING WHEELS

[75] Inventors: Frederick M. Reiber, Rehoboth, Mass.; Joseph P. Sejnowski, Cumberland, R.I.

[73] Assignee: Playskool, Inc., Pawtucket, R.I.

[21] Appl. No.: 45,617

[22] Filed: Apr. 9, 1993

[51] Int. Cl.[5] ..... A63C 17/04

[52] U.S. Cl. ..... 280/11.22; 280/11.26; 280/11.27

[58] Field of Search ..... 280/11.19, 11.22, 11.23, 280/11.26, 11.27, 64, 87.041, 87.042, 149.1, 293, 767; 180/906; 301/5.3, 120

[56] References Cited

U.S. PATENT DOCUMENTS

| | | | |
|---|---|---|---|
| 208,235 | 9/1878 | Gregg . | |
| 233,845 | 11/1880 | Gregg . | |
| 1,188,377 | 6/1916 | Weaver | 280/11.22 X |
| 1,609,612 | 12/1926 | Eskeland | 280/11.23 X |
| 2,245,769 | 6/1941 | Flamm | 280/11.23 X |
| 3,086,787 | 4/1963 | Wyche | 280/11.23 X |
| 3,351,353 | 11/1967 | Weitzner | 280/11.22 X |
| 3,387,852 | 6/1968 | De Sarro | 280/11.22 X |
| 3,963,252 | 6/1976 | Carlson | 280/11.22 |
| 4,272,091 | 6/1981 | Reid, Jr. | 280/11.28 |
| 4,836,567 | 6/1989 | Schmid | 280/11.22 X |
| 5,183,276 | 2/1993 | Pratt | 280/11.22 |
| 5,192,088 | 3/1993 | Yu | 280/11.27 X |

FOREIGN PATENT DOCUMENTS

| | | | |
|---|---|---|---|
| 2614547 | 11/1988 | France | 280/11.26 |
| 2250203 | 6/1992 | United Kingdom | 280/11.22 |

*Primary Examiner*—Brian L. Johnson

*Attorney, Agent, or Firm*—Salter, Michaelson & Benson

[57] ABSTRACT

A roller skate assembly includes a sole portion having longitudinally aligned front and rear rollers mounted thereon and a center roller which is mounted on the sole portion between the front and rear rollers. The center roller is alternatively positionable in a longitudinally aligned position relative to the front and rear rollers or a transversely offset position relative thereto.

6 Claims, 2 Drawing Sheets

IN LINE ROLLER SKATE ASSEMBLY HAVING TRAINING WHEELS

BACKGROUND OF THE INVENTION

The instant invention relates to roller skates and more particularly to an in-line roller skate assembly which is adapted for use by a small child.

Roller skates have generally been found to be capable of providing significant levels of amusement for persons of various ages, and as a result, they have been found to have relatively high levels of appeal. Recently, however, in-line roller skates which comprise a single row of longitudinally aligned rollers have been found to have even greater levels of appeal. In this regard, it has been found that the skating motions required to propel skaters on in-line roller skates are generally very similar to the motions required to propel skaters on hockey style ice skates, and that as a result, in-line roller skates can be utilized as an effective training device for ice skaters who normally use hockey style skates. It has also been found that in-line roller skates ar capable of providing significant levels of amusement and exercise for skaters who do not have regular access to ice rinks and the like. Even still further, it has been found that in-line roller skates provide a unique and enjoyable form of amusement and exercise which is readily available to persons of various ages.

While the concept of utilizing in-line roller skates, rather than roller skates which have pairs of rollers adjacent the front and rear ends thereof, has been found to be appealing to persons of various ages, it has been found that young children frequently experience difficulty in mastering the techniques required for using in-line roller skates. This is partially because young children frequently do not have prior experience with either roller skates or ice skates of any kind. It is also partially because young children inherently have reduced levels of strength, coordination and motor skills, and hence, it is frequently more difficult for them to become proficient at activities, such as, roller skating.

SUMMARY OF THE INVENTION

The instant invention provides novel and effective roller skate assembly which is essentially operative as an in-line roller skate but which is adapted to provide a substantially increased level of stability for a young child. More specifically, the instant invention provides an effective roller skate assembly comprising a sole portion, aligned front and rear rollers mounted on the sole portion and a center roller on the sole portion which is alternatively positionable in a first position in which it is longitudinally aligned with the front and rear rollers or a second position in which it is transversely off-set relative to the front and rear rollers. The roller skate assembly, therefore, comprises means for rotatably mounting the third or center roller on the sole portion so that it is releasably securable in an aligned position relative to the front and rear rollers or a transversely off-set position relative thereto. The means for mounting the third or center roller preferably comprises a carriage which is mounted on the sole portion so that it is transversely shiftable relative thereto for moving the third or center roller between the first and second positions thereof. The sole portion is preferably also adjustable to different lengths, and the front, rear and center rollers, preferably each comprise only a single roller. The front and rear rollers are preferably mounted adjacent the front and rear ends of the sole portion, and the center or third roller is normally mounted approximately midway between the front and rear rollers. The roller skate assembly preferably further includes a shoe upper portion for securing the roller skate assembly to a foot of a wearer.

It has been found that the roller skate assembly of the instant invention represent a significant improvement in that it provides a relatively safe in-line roller skate assembly for young children which is operable with a significantly increased level of stability. Specifically, it has been found that because the roller skate assembly of the instant invention includes a transversely shiftable center roller, the roller skate assembly can be effectively utilized by a young child. Further once a young child gains a level of proficiency at utilizing the roller skate assembly, the center wheel can be shifted inwardly to an aligned position to enable the roller skate assembly to be utilized in a manner similar to a conventional in-line roller skate assembly. Hence, the roller skate assembly of the instant invention has the increased appeal of an in-line roller skate assembly, but it nevertheless provides an effective mechanism by which a young child can gain the necessary confidence and stability to utilize in-line roller skates.

Roller skate assemblies and similar devices representing the closest prior art to the subject invention of which the applicant is aware, are disclosed in the U.S. Patents to Gregg No. 208,235; Gregg No. 233,845; Eskeland No. 1,609,612; Flamm No. 2,245,769; Wyche No. 3,086,787; Reid 4,272,091; Schmid No. 4,836,567 and Pratt No. 5,183,276. However, since the devices disclosed in these references fail to suggest the concept of providing a roller skate assembly comprising aligned front and rear rollers and a center roller which is transversely shiftable relative to the front and rear rollers, they are believed to be of only general interest with respect to the subject invention.

Accordingly, it is a primary object of the instant invention to provide an in-line roller skate assembly which can be effectively utilized by a young child.

Another object of the subject invention is to provide a roller skate assembly comprising a center roller which is transversely shiftable to provide an increased level of stability for a user of the roller skate assembly.

An even still further object of the instant invention is to provide an in-line roller skate assembly comprising aligned front and rear rollers and a center roller which is shiftable between an aligned position relative to the front and rear rollers and a transversely shifted position relative thereto.

Other objects, features and advantages of the invention shall become apparent as the description thereof proceeds when considered in connection with the accompanying illustrative drawing.

DESCRIPTION OF THE DRAWINGS

In the drawings which illustrate the best mode presently contemplated for carrying out the present invention.

DESCRIPTION OF THE INVENTION

Figure 1:
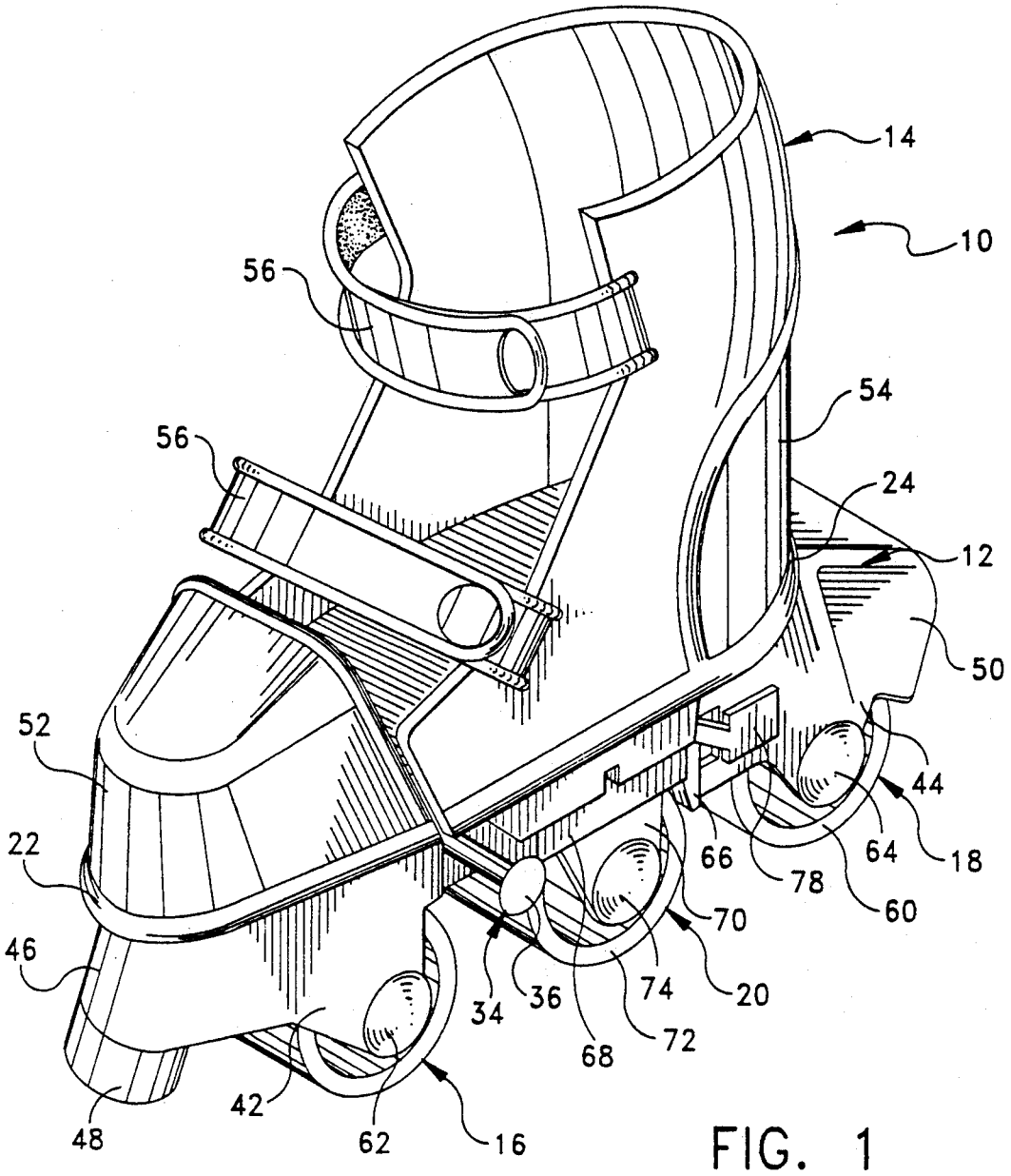
FIG. 1 is a perspective view of the roller skate assembly of the instant invention.
Figure 2:
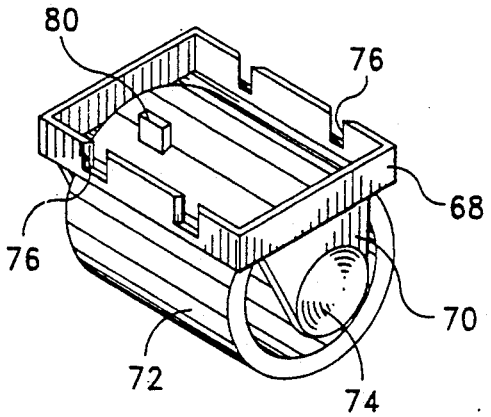
FIG. 2 is a perspective view of the center roller assembly.

Referring now to the drawings, the roller skate assembly of the instant invention is illustrated and generally indicated at 10 in FIG. 1 The roller skate assembly 10 comprises a sole portion generally indicated at 12, an upper portion generally indicated at 14, front and rear roller assemblies generally indicated at 16 and 18, respectively, and a center roller assembly generally indicated at 20. The roller skate assembly 10 is adapted so that the sole portion 12 is longitudinally extendable for adjusting the roller skate assembly 10 to accommodate different foot sizes. Further, the center roller assembly 20 is adapted to be transversely shifted from the aligned position illustrated in FIG. 3 to the nonaligned or transversely off-set position illustrated in FIG. 4. In this regard, when the center roller assembly 20 is in the aligned position illustrated in FIG. 3, the roller skate assembly 10 is operative in a manner similar to a conventional in-line roller skate assembly. However, when the center roller assembly 20 is in the transversely offset second position thereof illustrated in FIG. 4, the roller skate assembly 10 is operative for providing an increased level of stability for a youthful user thereof.

Figure 3:
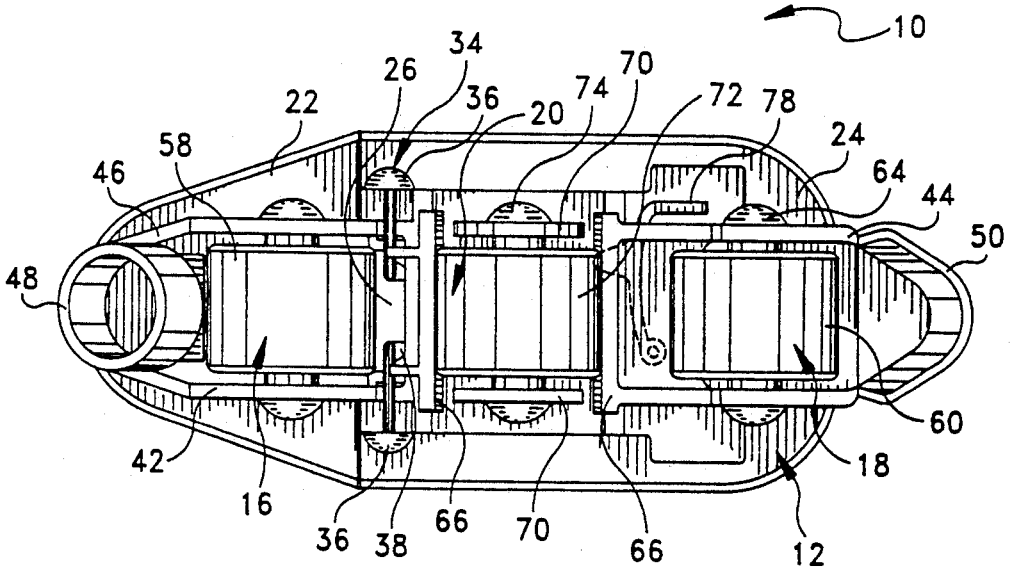
FIG. 3 is a bottom plan view of the roller skate assembly with the center roller in an aligned or first position.
Figure 4:
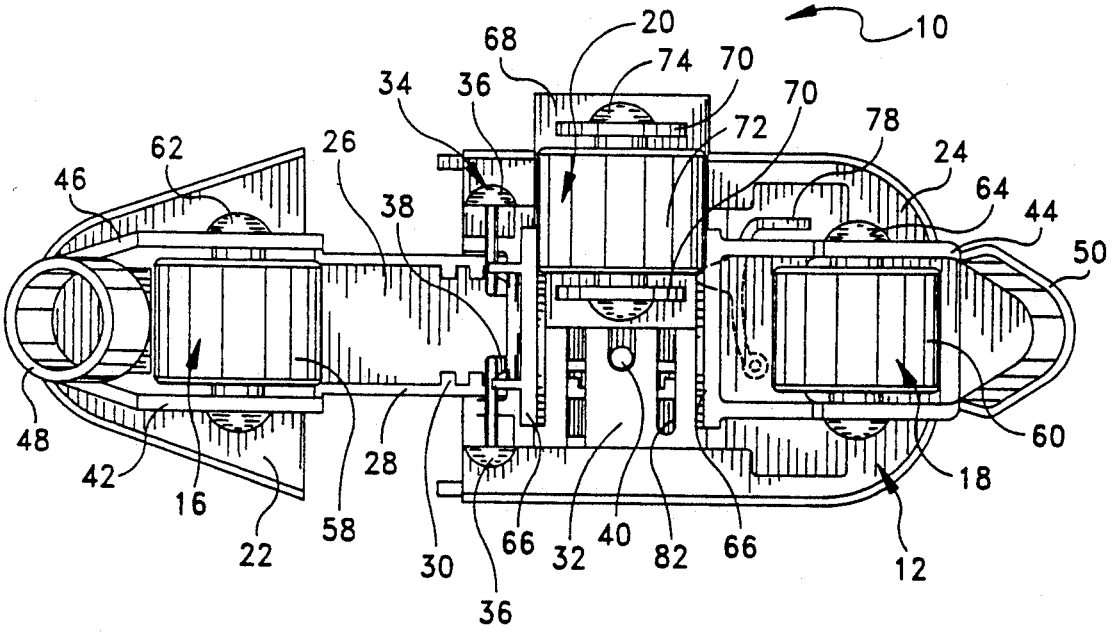
FIG. 4 is a similar view with the center roller in a transversely shifted position and the sole portion in a longitudinally extended position.

The sole portion 12 is illustrated most clearly in FIGS. 3 and 4, and it is adapted to be longitudinally adjusted to various lengths in order to accommodate various foot sizes. The sole portion 12 comprises a front portion 22 and a rear portion 24. The front portion 22 includes a slide portion 26 which is slidably received in the rear portion 24 for adjustably connecting the front and rear portions 22 and 24. The slide portion 26 includes side walls 28 having a plurality of inwardly extending ridges 30 formed thereon, and it is slidably received in a trackway 32 which is formed on the underside of the rear portion 24. Attached to the rear portion 24 is a locking mechanism 34 comprising a pair of buttons 36 which extend outwardly from a pair of outwardly biased arms 38. The arms 38 include latch members 40 which are receivable in engagement between the ridges 30 for releasably securing the front portion 22 in various adjusted positions relative to the rear portion 24. Specifically, the button portions 36 are movable inwardly and together to disengage the latch portions 40 on the arms 38 from between the ridges 30 to permit the slide portion 26 to be longitudinally repositioned in the trackway 32.

The front and rear sole portions 22 and 24, respectively, are integrally formed with front and rear roller mounting assemblies 42 and 44, respectively, which are operative for rotatable mounting the front and rear roller assemblies 16 and 18, respectively, on the underside of the sole portion 12. The front roller mounting assembly 42 is also integrally formed with a front stop mounting assembly 46 having a circular front stop element 48 mounted thereon. The front stop element 48 is operative for preventing the roller skate assembly 10 from tilting forwardly beyond a predetermined angle of inclination as well as for an enabling a user to "push off" and/or perform certain skating maneuvers. The rear roller mounting assembly 44 is integrally formed with a rear stop 50 which is operative for preventing the skate assembly 10 from tilting rearwardly beyond a predetermined angle of inclination.

The skate upper 14 is preferably made from a suitable plastic material, and it comprises front and rear portions 52 and 54, respectively, which are formed on the front and rear sole portions 22 and 24, respectively. The front portion 52 is formed as a toe portion for receiving the toes on a foot of a user. The rear portion 54 is formed as a shoe upper and it includes a pair of straps 56 which are operable for securing the upper portion 14 around an ankle of the user. Further, the straps 56 and the rear portion 54 are preferably adapted to enable the upper portion 14 to provide a certain level of ankle support for the user during a skating exercise.

The front and rear roller assemblies 16 and 18, respectively comprise front and rear roller 58 and 60, respectively, which are mounted in the front and rear roller mounting assemblies 42 and 44, respectively. Specifically, the front and rear rollers 58 and 60 are mounted in substantially longitudinally aligned relation on mounting shaft 62 and 64, respectively, which pass through the rollers 58 and 60 terminating in enlarged end portions.

The third or center roller assembly 20 comprises a transversely extending trackway 66, which is integrally formed on the underside of the sole portion 12, and a carriage 68, which is transversely slidable in the trackway 66. The carriage 68 includes a pair of downwardly extending roller mounts 70. Also included in the center roller assembly 20 is a center roller 72 which is mounted in the mounts 70 with a center shaft 74 which also terminates in enlarged ends. Accordingly, the roller 72 is rotatably mounted on the carriage 68, and it is alternatively positionable in the first or aligned position thereof, illustrated in FIG. 3 or the transversely shifted nonaligned second position thereof, illustrated in FIG. 4. Specifically, the carriage 68 is transversely shiftable to reposition the roller 72 in this manner. The carriage 72 has a pair of side slots 76 formed therein and a latch member 78 is mounted on the rear sole portion 24 so that it is biased to a position of engagement with the carriage 68. Specifically, the latch member 78 is alternatively receivable in either of the slots 76 for releasably securing the carriage 68 in the first or second positions thereof. The carriage 68 further includes a lug 80 which travels in a slot 82 formed in the trackway 32 for limiting the outward movement of the carriage 68 beyond the second position thereof, illustrated in FIG. 4.

It is seen therefore that the instant invention provides an effective roller skate assembly which is specifically adapted for use by a young child. The sole portion 12 is adjustable to different lengths by squeezing the buttons 36 together to disengage the latch elements 40 from the ridges 30 so that the slide portion 26 can be longitudinally repositioned in the trackway 32. Further, by pivoting the latch element 78 rearwardly, the latch element 78 can be disengaged from the carriage 68 so that the carriage 68 can be shifted between the first and second positions thereof and then resecured by allowing the latch element 78 to again pass into a different slot 76. Hence it is seen that the roller skate assembly of the instant invention represents a significant improvement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A roller skate assembly comprising a sole portion for receiving a foot of a wearer thereon; means for securing said sole portion to the foot of the wearer; first and second roller means; means for rotatably mounting said first and second roller means on said sole portion for rotation about first and second spaced, substantially parallel, transverse axes of rotation so that said first and second roller means are in substantially longitudinally aligned relation on said sole portion and so that said first and second roller means are operable for movably supporting said sole portion and said wearer on a supporting surface, third roller means, carriage means, means for rotatably mounting said third roller means on said carriage means, and carriage mounting means for mounting said carriage means on said sole portion so that said third roller means is rotatable about a third axis which is substantially parallel to said first and second axes, said carriage mounting means mounting said carriage means so that said third roller means is operative in cooperation with said first and second roller means for supporting said roller skate assembly on said supporting surface and being operable for alternatively positioning said third roller means in a first position along said third axis of substantially longitudinally aligned relation to said first and second roller means and a second transversely shifted position along said third axis of longitudinally nonaligned relation to said first and second roller means.

2. In the roller skate assembly of claim 1, said means for rotatably mounting said third roller means including means for releasably securing said third roller means in said first and second positions.

3. The roller skate assembly of claim 1 further comprising means for adjusting said sole portion to different lengths.

4. In the roller skate assembly of claim 1, said sole portion having front and rear ends, said means for mounting said first and second roller means mounting said first and second roller means proximal the front and rear ends of said sole portion, said means for mounting said third roller means mounting said third roller means so that said third axis is disposed between said first and second axes.

5. In the roller skate assembly of claim 1, said first, second and third roller means each comprising only a single roller.

6. In the roller skate assembly of claim 1, said means for securing said sole portion to a foot of a wearer comprising a shoe upper portion.

* * * * *